United States Patent [19]

Lin et al.

[11] Patent Number: 4,978,110

[45] Date of Patent: Dec. 18, 1990

[54] FIRE PROTECTION UNBRELLA

[76] Inventors: Muh Q. Lin, No. 24, Huan Pei Rd., Alley 3, Kuang Ming Li, Chung Li, Tao Yuan Hsien; Pi F. Lin, 3Fl., No. 36, Jenn Fu St., Tao Yuan; Yih J. Lin, No. 36, Kuang Wen St., Tao Yuan; Cheng H. Lin, No. 17, Lane 42, Yung-I St., Tao Yuan; Ming J. Lin, Tao Yuan Hsien, all of Taiwan

[21] Appl. No.: 523,866

[22] Filed: May 14, 1990

[51] Int. Cl.[5] ..... A45B 11/00

[52] U.S. Cl. ..... 135/20; 135/DIG. 10; 135/33 R; 135/36 RT; 182/47; 244/142

[58] Field of Search ..... 135/19.5, 33 R, 36 RT, 135/44; 182/47; 244/146, 142, 143, 145

[56] References Cited

U.S. PATENT DOCUMENTS

| | | | |
|---|---|---|---|
| 1,043,836 | 11/1912 | Hodge | 244/143 |
| 1,166,272 | 12/1915 | Smithing | 135/DIG. 10 X |
| 1,707,473 | 4/1929 | Goldberg | 240/64 X |
| 2,502,984 | 4/1950 | Parmenter | 135/33 R X |
| 4,848,385 | 7/1989 | Pennella | 135/DIG. 10 X |
| 4,872,468 | 10/1989 | Cole | 135/33 R X |

FOREIGN PATENT DOCUMENTS

| | | | |
|---|---|---|---|
| 489551 | 2/1919 | France | 244/143 |
| 410702 | 4/1945 | Italy | 135/33 R |
| 13255 | of 1913 | United Kingdom | 244/142 |

*Primary Examiner*—David A. Scherbel
*Assistant Examiner*—Lan Mai
*Attorney, Agent, or Firm*—Asian Pacific Int'l. Patent and Trademark Off.

[57] ABSTRACT

A fire protection umbrella, which comprises a fire-proof umbrella cover coated with fire retarding paint and fully covered with ceramic elements or ceramic wafers. A flash light is attached to the handle of the umbrella to produce light. A hood is attached to the bottom of the umbrella cover to cover one's head on an emergency. The umbrella ribs may be bound up with the shaft of the umbrella frame by a cord to prevent the umbrella cover from collapse in counter direction so that the umbrella may be used as a parachute to help one escape from a high-raised building.

3 Claims, 2 Drawing Sheets

FIRE PROTECTION UNBRELLA

BACKGROUND OF THE INVENTION

The present invention is related to umbrellas and more particularly to an umbrella for fire protection and to help one escape from fire.

In high-raised buildings, fire escape ladder or stairway, inflatable slip belt, flexible fire escape tube or certain fire escape equipments must be provided for use during the outbreak of a fire. However, there is few aids provided in high-raised buildings to help one find an exit to escape from a fire. In fire cases various people died from heavy smoke or fire during fire accident due to no fire escape equipment available to help one pass through a fire or find the correct way to escape.

SUMMARY OF THE INVENTION

The present invention has been accomplished under the circumstances in view. It is one object of the present invention to provide a fire protection unbrella which can protect one against a fire.

Another object of the present invention is to provide a fire protection umbrella which can produce light to help one find a fire escape.

Still another object of the present invention is to provide a fire protection umbrella which can protect one's head against heavy smoke so as to help one escape from a fire rapidly.

Still another object of the present invention is to provide a fire protection umbrella which can be used as a parachute to help one escape from a high-raised building on an emergency.

A yet further object of the present invention is to provide a fire protection umbrella which is easy to operate.

To accomplish the above objects and according to one aspect of the present invention, a fire protection umbrella comprises an umbrella cover stretched over a folding radial umbrella frame, in which the umbrella cover is made of asbestos cloth coated with fire retarding paint and covered with ceramic tubes or wafers and the umbrella ribs of the umbrella frame are each attached with a ceramic socket at its protruding end.

According to another aspect of the present invention, a fire protection umbrella comprises a flash light attached to the handhold portion of its umbrella frame, which produces light for illumination on an emergency so as to help one find a fire escape under heavy smoke situation.

According to a further aspect of the present invention, a fire protection umbrella comprises a horn-like hood attached to the bottom of the umbrella cover thereof to retain certain quantity of fresh air so that one's head can be covered therein for a certain period of time while one is escaping from a fire.

According to a yet further aspect of the present invention, the umbrella ribs of a fire protection umbrella are each consisted of two stell strips which are bound up with the shaft of the umbrella frame by a cord to protect the umbrella ribs against collapsing in counter direction while a fire protection umbrella is used as a parachute to help one escape from a high-raised building.

Further objects, features and other aspects of the present invention will be understood from the following detailed description of preferred embodiments of this invention referring to the annexed drawings.

DETAILED DESCRIPTION OF THE PREFERRED EMBODIMENTS

Figure 1:
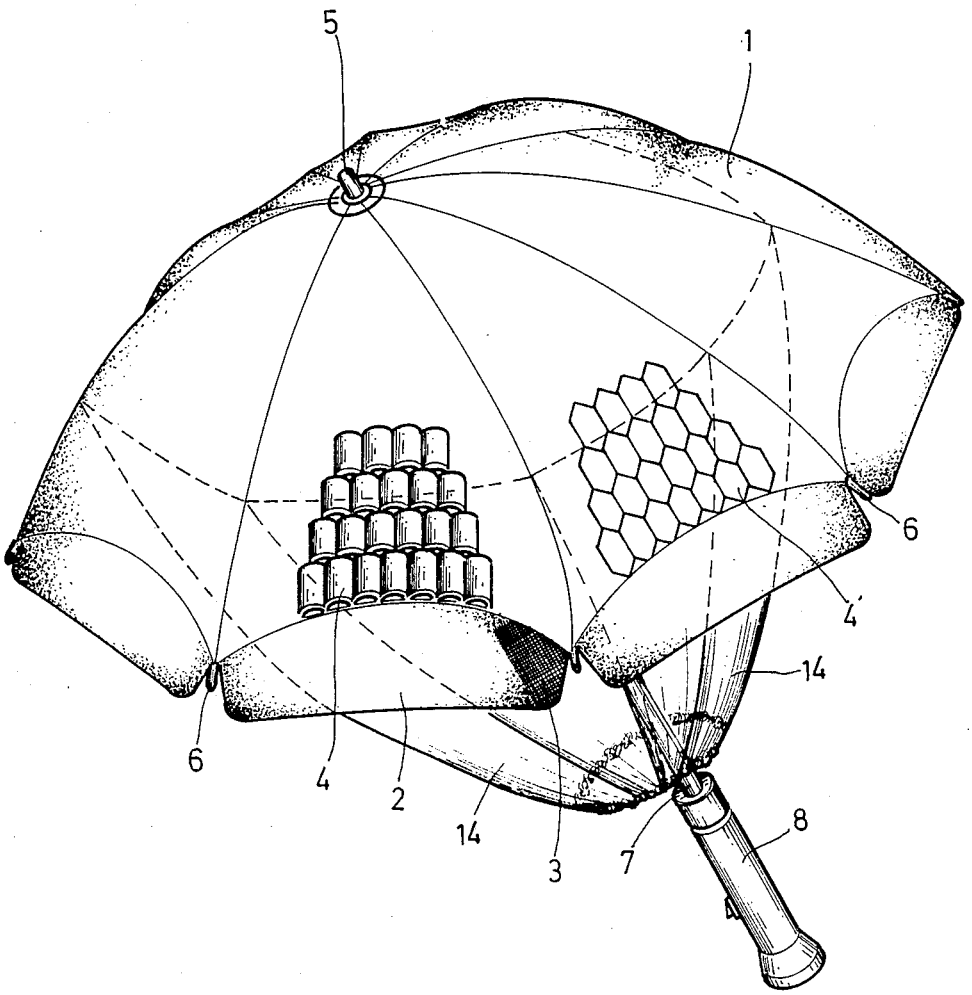
FIG. 1 is a perspective view of a fire protection umbrella emboding the present invention.

Referring to the annexed drawings in greater detail, an umbrella cover 1 in accordance with the present invention is made of asbestos cloth 2 coated with fire retarding paint 3 and covered with hollow ceramic tubes 4 or ceramic wafers 4' to form a ceramic insulation layer. The hollow ceramic tubes 4 are each designed in a semi-elliptic shape with its flat surface portion closely attached to the umbrella cover 1. The hoop of the shaft 7 and the protruding ends of the umbrella ribs are respectively covered with ceramic sockets 5 or 6. The handhold portion of the shaft 7 is coupled with a flash light 8 to emit light for illumination. A horn-like hood 14 is made on the bottom of the umbrella cover 1 to retain certain quantity of fresh air so that one's head can be covered therein for a certain period of time on an emergency. When the electric power supply of a building is cut off during fire accident, the flash light 8 is used to emit light and the fire protection umbrella of the present invention is stretched open to protect against the fire so that one can easily find the right way to escape from the fire.

In order to fully cover an user against the fire, it is better to increase the size of the umbrella cover to a certain extent. The most preferably size of a fire protection umbrella in accordance with the present invention is equivalent to the size of regular beach umbrella.

Figure 2:
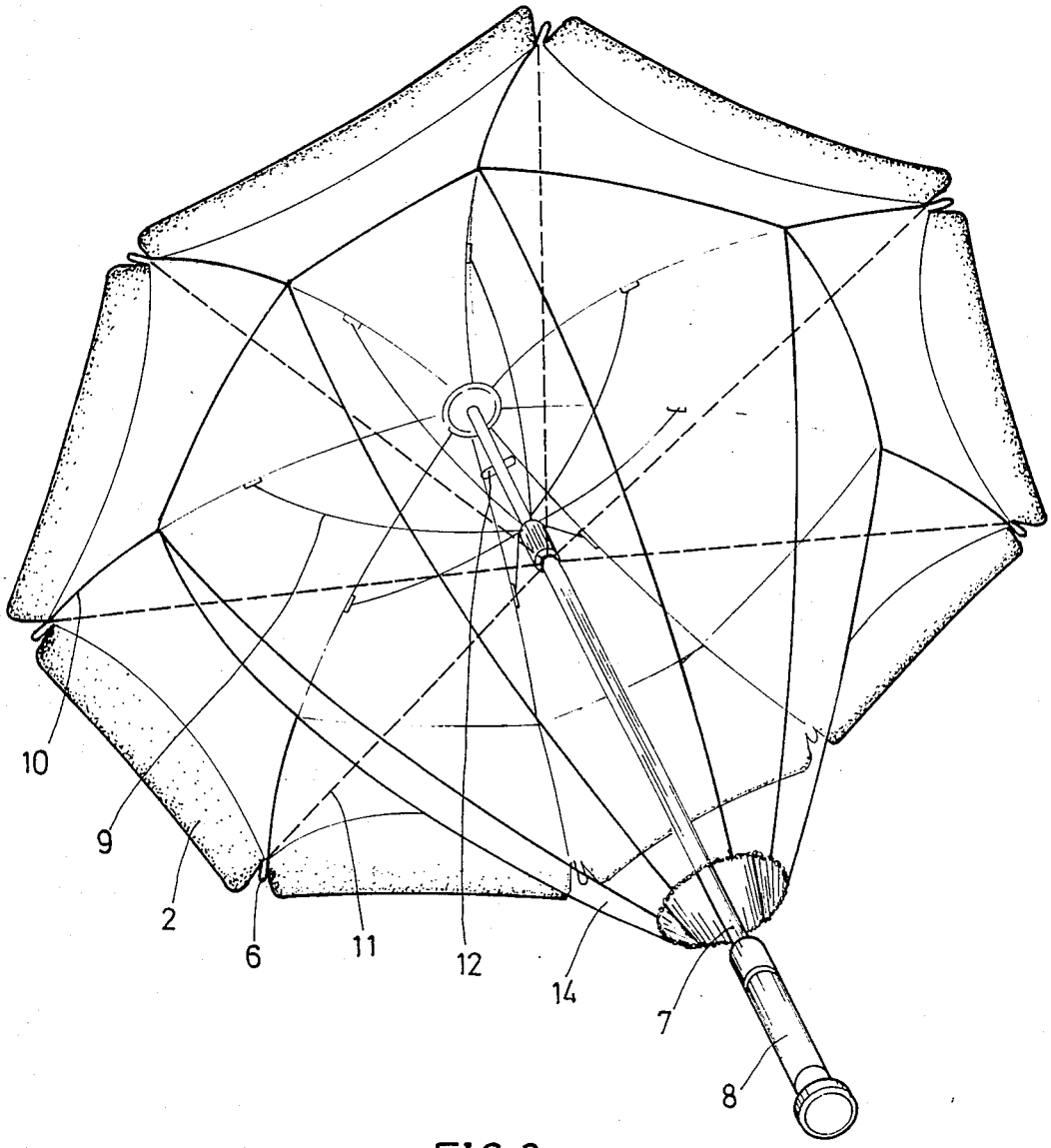
FIG. 2 is an obliquely bottom view thereof.

FIG. 2 illustrates the inner structure of a fire protection umbrella according to the present invention. In order to reinforce the umbrella frame of the fire protection umbrella, the umbrella rib 9, is consisted of two steel strips. By means of the arrangement of the double-strip structure of umbrella rib 10, the umbrella cover 1 is firmly secured to the umbrella frame when it is stretched open by the umbrella rib 10. The umbrella ribs may be bound up with the shaft 7 by a cord 11 so that the umbrella cover 1 can be firmly retained in position. Even if strong wind force is acted on the inner side of the umbrella cover 1, the umbrella cover 1 will not be collapsed in counter direction. Therefore, a fire protection umbrella of the present invention can also be used as a parachute to retard the falling speed of a person when a person jumps from a high-raised building on an emergency.

There is a lamp bulb 12 mounting on the shaft 7 of the umbrella frame at an upper end position and controlled by the same switch which controls the flash light 8. The lamp bulb 12 can be turned on to give a video signal to ask for help or to illuminate the ground to so as to help one find a fire escape during fire accident.

As is apparent from the foregoing specification, the present invention is susceptible of being embodied with various alterations and modifications which may differ particularly from those that have been described in the above specification and description. Recognizing that various modifications been possible, the scope herein shall be deemed as defined in the claims set forth hereinafter.

What is claimed is:

1. A fire protection umbrella, comprising:

a folding radial frame comprised of a shaft and a plurality of umbrella ribs, said shaft being covered with a ceramic socket on its top end, said umbrella ribs being each consisted of two steel strips covered with a ceramic socket on its bottom end;

an umbrella cover stretched over said folding radial frame and being made of asbestos cloth coated with fire retarding paint and fully covered with ceramic elements;

a lamp bulb and a flash light respectively mounted on said shaft at its upper and lower ends; and a transparent hood extending downward from said umbrella cover.

2. A fire protection umbrella as claimed in claim 1, wherein said ceramic elements are designed in hollow, semi-elliptic shape having each a flat bottom surface closely attached to said umbrella cover.

3. A fire protection umbrella as claimed in claim 1, wherein said ceramic elements are made of ceramic wafers.

* * * * *